US011295685B2

(12) United States Patent
Huang

(10) Patent No.: US 11,295,685 B2
(45) Date of Patent: Apr. 5, 2022

(54) DRIVING METHOD AND DEVICE FOR DISPLAY PANEL

(71) Applicant: HKC CORPORATION LIMITED, Shenzen (CN)

(72) Inventor: Beizhou Huang, Shenzen (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/954,849

(22) PCT Filed: Sep. 7, 2018

(86) PCT No.: PCT/CN2018/104550
§ 371 (c)(1),
(2) Date: Jun. 17, 2020

(87) PCT Pub. No.: WO2019/119881
PCT Pub. Date: Jun. 27, 2019

(65) Prior Publication Data

US 2021/0090515 A1 Mar. 25, 2021

(30) Foreign Application Priority Data

Dec. 18, 2017 (CN) ..... 201711368980.0

(51) Int. Cl.
*G09G 3/36* (2006.01)

(52) U.S. Cl.
CPC ..... *G09G 3/3614* (2013.01); *G09G 3/3607* (2013.01); *G09G 2320/0242* (2013.01)

(58) Field of Classification Search
CPC ..... G09G 3/3607; G09G 3/3614; G09G 2320/0209; G09G 2320/0242;
(Continued)

(56) References Cited

U.S. PATENT DOCUMENTS

2008/0088559 A1 4/2008 Lai et al.
2015/0235614 A1* 8/2015 Kim ..... G09G 3/3413 345/205

(Continued)

FOREIGN PATENT DOCUMENTS

CN 101211029 A 7/2008
CN 103456257 A 12/2013

(Continued)

OTHER PUBLICATIONS

International Search Report issued for the corresponding international application No. PCT/CN2018/104550, dated Nov. 22, 2018, 2 pages (English Translation).

*Primary Examiner* — Nelson M Rosario
(74) *Attorney, Agent, or Firm* — Snyder, Clark, Lesch & Chung, LLP

(57) ABSTRACT

The present disclosure illustrates a driving method of a display panel and a driver device thereof. The method comprises steps of: applying drive voltages with opposite polarities to drive the positional corresponding sub-pixels of the two adjacent rows of pixel units, wherein the voltages with opposite polarities comprise voltage with positive polarity and voltage with negative polarity; applying voltages with positive polarity to a part of the positional corresponding sub-pixels of the two adjacent rows of pixel units; applying voltage with negative polarity to the other part of the positional corresponding sub-pixels of the two adjacent rows of pixel units; applying two drive voltages with opposite polarities to drive sub-pixels of the same pixel unit; applying drive voltages with at least two voltage levels to drive sub-pixels of the same pixel unit, and separating the plurality of sub-pixels according to the drive voltages with voltage levels.

15 Claims, 10 Drawing Sheets

20

| | | | |
|---|---|---|---|
| P(i, j) | P(i, j+1) | P(i, j+2) | P(i, j+3) |
| P(i+1, j) | P(i+1, j+1) | P(i+1, j+2) | P(i+1, j+3) |
| P(i+2, j) | P(i+2, j+1) | P(i+2, j+2) | P(i+2, j+3) |
| P(i+3, j) | P(i+3, j+1) | P(i+3, j+2) | P(i+3, j+3) |
| P(i+4, j) | P(i+4, j+1) | P(i+4, j+2) | P(i+4, j+3) |
| P(i+5, j) | P(i+5, j+1) | P(i+5, j+2) | P(i+5, j+3) |

(58) Field of Classification Search
CPC ..... G09G 3/364; G09G 3/3685; G09G 2310/027; G09G 2320/0276; G09G 2320/0673; G09G 2320/0686; G09G 3/3648; G09G 3/3655; G09G 2300/0426; G09G 2300/0452; G09G 2300/0465; G09G 2330/021; G02F 1/136286; G02F 1/1368; G02F 2201/40; G02F 2201/52; H01L 27/124; H01L 29/785; H01L 29/78696
See application file for complete search history.

(56) References Cited

U.S. PATENT DOCUMENTS

| | | | | |
|---|---|---|---|---|
| 2017/0116934 | A1* | 4/2017 | Tien | G09G 3/364 |
| 2017/0256228 | A1* | 9/2017 | Lee | G09G 3/3614 |
| 2018/0267377 | A1* | 9/2018 | Ying | G02F 1/1368 |

FOREIGN PATENT DOCUMENTS

| | | | |
|---|---|---|---|
| CN | 105304010 | A | 2/2016 |
| CN | 106782404 | A | 5/2017 |
| CN | 108109587 | A | 6/2018 |
| CN | 108109596 | A | 6/2018 |

* cited by examiner

20

| | | | |
|---|---|---|---|
| P(i, j) | P(i, j+1) | P(i, j+2) | P(i, j+3) |
| P(i+1, j) | P(i+1, j+1) | P(i+1, j+2) | P(i+1, j+3) |
| P(i+2, j) | P(i+2, j+1) | P(i+2, j+2) | P(i+2, j+3) |
| P(i+3, j) | P(i+3, j+1) | P(i+3, j+2) | P(i+3, j+3) |
| P(i+4, j) | P(i+4, j+1) | P(i+4, j+2) | P(i+4, j+3) |
| P(i+5, j) | P(i+5, j+1) | P(i+5, j+2) | P(i+5, j+3) |

FIG. 2

20

P(i, j)

| | | | | | | | | | | | | | | | |
|---|---|---|---|---|---|---|---|---|---|---|---|---|---|---|---|
| R H+ (i, j) | G L− (i, j) | B H− (i, j) | W L+ (i, j) | R H− (i, j+1) | G L+ (i, j+1) | B H+ (i, j+1) | W L− (i, j+1) | R H+ (i, j+2) | G L− (i, j+2) | B H− (i, j+2) | W L+ (i, j+2) | R H− (i, j+3) | G L+ (i, j+3) | B H+ (i, j+3) | W L− (i, j+3) |
| R L+ (i+1, j) | G H− (i+1, j) | B L− (i+1, j) | W H+ (i+1, j) | R L− (i+1, j+1) | G H+ (i+1, j+1) | B L+ (i+1, j+1) | W H− (i+1, j+1) | R L+ (i+1, j+2) | G H− (i+1, j+2) | B L− (i+1, j+2) | W H+ (i+1, j+2) | R L− (i+1, j+3) | G H+ (i+1, j+3) | B L+ (i+1, j+3) | W H− (i+1, j+3) |
| R H+ (i+2, j) | G L− (i+2, j) | B H− (i+2, j) | W L+ (i+2, j) | R H− (i+2, j+1) | G L+ (i+2, j+1) | B H+ (i+2, j+1) | W L− (i+2, j+1) | R H+ (i+2, j+2) | G L− (i+2, j+2) | B H− (i+2, j+2) | W L+ (i+2, j+2) | R H− (i+2, j+3) | G L+ (i+2, j+3) | B H+ (i+2, j+3) | W L− (i+2, j+3) |
| R L+ (i+3, j) | G H− (i+3, j) | B L− (i+3, j) | W H+ (i+3, j) | R L− (i+3, j+1) | G H+ (i+3, j+1) | B L+ (i+3, j+1) | W H− (i+3, j+1) | R L+ (i+3, j+2) | G H− (i+3, j+2) | B L− (i+3, j+2) | W H+ (i+3, j+2) | R L− (i+3, j+3) | G H+ (i+3, j+3) | B L+ (i+3, j+3) | W H− (i+3, j+3) |
| R H+ (i+4, j) | G L− (i+4, j) | B H− (i+4, j) | W L+ (i+4, j) | R H− (i+4, j+1) | G L+ (i+4, j+1) | B H+ (i+4, j+1) | W L− (i+4, j+1) | R H+ (i+4, j+2) | G L− (i+4, j+2) | B H− (i+4, j+2) | W L+ (i+4, j+2) | R H− (i+4, j+3) | G L+ (i+4, j+3) | B H+ (i+4, j+3) | W L− (i+4, j+3) |
| R L+ (i+5, j) | G H− (i+5, j) | B L− (i+5, j) | W H+ (i+5, j) | R L− (i+5, j+1) | G H+ (i+5, j+1) | B L+ (i+5, j+1) | W H− (i+5, j+1) | R L+ (i+5, j+2) | G H− (i+5, j+2) | B L− (i+5, j+2) | W H+ (i+5, j+2) | R L− (i+5, j+3) | G H+ (i+5, j+3) | B L+ (i+5, j+3) | W H− (i+5, j+3) |

FIG. 3

20

| | | | | | | | | | | | | | | | |
|---|---|---|---|---|---|---|---|---|---|---|---|---|---|---|---|
| R<br>H−<br>(i, j) | G<br>L+<br>(i, j) | B<br>H+<br>(i, j) | W<br>L−<br>(i, j) | R<br>H+<br>(i, j+1) | G<br>L−<br>(i, j+1) | B<br>H−<br>(i, j+1) | W<br>L+<br>(i, j+1) | R<br>H−<br>(i, j+2) | G<br>L+<br>(i, j+2) | B<br>H+<br>(i, j+2) | W<br>L−<br>(i, j+2) | R<br>H+<br>(i, j+3) | G<br>L−<br>(i, j+3) | B<br>H−<br>(i, j+3) | W<br>L+<br>(i, j+3) |
| R<br>L−<br>(i+1, j) | G<br>H+<br>(i+1, j) | B<br>L+<br>(i+1, j) | W<br>H−<br>(i+1, j) | R<br>L+<br>(i+1, j+1) | G<br>H−<br>(i+1, j+1) | B<br>L−<br>(i+1, j+1) | W<br>H+<br>(i+1, j+1) | R<br>L−<br>(i+1, j+2) | G<br>H+<br>(i+1, j+2) | B<br>L+<br>(i+1, j+2) | W<br>H−<br>(i+1, j+2) | R<br>L+<br>(i+1, j+3) | G<br>H−<br>(i+1, j+3) | B<br>L−<br>(i+1, j+3) | W<br>H+<br>(i+1, j+3) |
| R<br>H−<br>(i+2, j) | G<br>L+<br>(i+2, j) | B<br>H+<br>(i+2, j) | W<br>L−<br>(i+2, j) | R<br>H+<br>(i+2, j+1) | G<br>L−<br>(i+2, j+1) | B<br>H−<br>(i+2, j+1) | W<br>L+<br>(i+2, j+1) | R<br>H−<br>(i+2, j+2) | G<br>L+<br>(i+2, j+2) | B<br>H+<br>(i+2, j+2) | W<br>L−<br>(i+2, j+2) | R<br>H+<br>(i+2, j+3) | G<br>L−<br>(i+2, j+3) | B<br>H−<br>(i+2, j+3) | W<br>L+<br>(i+2, j+3) |
| R<br>L−<br>(i+3, j) | G<br>H+<br>(i+3, j) | B<br>L+<br>(i+3, j) | W<br>H−<br>(i+3, j) | R<br>L+<br>(i+3, j+1) | G<br>H−<br>(i+3, j+1) | B<br>L−<br>(i+3, j+1) | W<br>H+<br>(i+3, j+1) | R<br>L−<br>(i+3, j+2) | G<br>H+<br>(i+3, j+2) | B<br>L+<br>(i+3, j+2) | W<br>H−<br>(i+3, j+2) | R<br>L+<br>(i+3, j+3) | G<br>H−<br>(i+3, j+3) | B<br>L−<br>(i+3, j+3) | W<br>H+<br>(i+3, j+3) |
| R<br>H−<br>(i+4, j) | G<br>L+<br>(i+4, j) | B<br>H+<br>(i+4, j) | W<br>L−<br>(i+4, j) | R<br>H+<br>(i+4, j+1) | G<br>L−<br>(i+4, j+1) | B<br>H−<br>(i+4, j+1) | W<br>L+<br>(i+4, j+1) | R<br>H−<br>(i+4, j+2) | G<br>L+<br>(i+4, j+2) | B<br>H+<br>(i+4, j+2) | W<br>L−<br>(i+4, j+2) | R<br>H+<br>(i+4, j+3) | G<br>L−<br>(i+4, j+3) | B<br>H−<br>(i+4, j+3) | W<br>L+<br>(i+4, j+3) |
| R<br>L−<br>(i+5, j) | G<br>H+<br>(i+5, j) | B<br>L+<br>(i+5, j) | W<br>H−<br>(i+5, j) | R<br>L+<br>(i+5, j+1) | G<br>H−<br>(i+5, j+1) | B<br>L−<br>(i+5, j+1) | W<br>H+<br>(i+5, j+1) | R<br>L−<br>(i+5, j+2) | G<br>H+<br>(i+5, j+2) | B<br>L+<br>(i+5, j+2) | W<br>H−<br>(i+5, j+2) | R<br>L+<br>(i+5, j+3) | G<br>H−<br>(i+5, j+3) | B<br>L−<br>(i+5, j+3) | W<br>H+<br>(i+5, j+3) |

FIG. 4

DRIVING METHOD AND DEVICE FOR DISPLAY PANEL

CROSS-REFERENCE TO RELATED APPLICATION

This application is a National Stage Application of PCT International Patent Application No. PCT/CN2018/104550 filed on Sep. 7, 2018, which claims priority to and the benefit of Chinese Patent Application No. 201711368980.0, filed on Dec. 18, 2017, and the disclosures of which are incorporated herein in their entirety by reference.

BACKGROUND

1. Field

The present disclosure relates to a display technology field, more particularly to a driving method of a display panel, and a driver device thereof.

2. Description of the Related Art

General display panels have color shift problem due to the deflection angle of the liquid crystal molecule or bad light emission stability of organic light-emitting diode component.

In order to improve the color shift problem, a conventional driving method of a display panel is to apply different drive voltage signals to two adjacent pixel units, respectively, and at the same time, the two adjacent sub-pixel are applied by the drive voltages with opposite polarities. The conventional driving method can solve the color shift problem, but also cause the mismatch of the positive and negative polarities of the high voltage applied on the same color sub-pixel in the same column; that is, in the same column, a number of the same color sub-pixels applied by the high voltage with positive polarity is different from a number of the same sub-pixels applied by the high voltage with negative polarity. For this reason, when the number of the same color sub-pixels applied with the high voltage with positive polarity is higher than the number of the same color sub-pixels applied with the high voltage with negative polarity in the same column, the equivalent voltage of the common electrode voltage Vcom is increased to be higher than the original common electrode voltage Vcom because of the parasitic capacitance, and it may cause that the sub-pixel applied by the high voltage with positive polarity is charged less to have lower brightness, and the sub-pixel applied by the high voltage with negative polarity is changed more to have higher brightness. As a result, the picture color and quality of the display panel is affected to cause an abnormal problem in picture quality.

SUMMARY

In order to solve the conventional problem, the present disclosure is to provide a driving method of a display panel and a driver device thereof, to prevent the common electrode voltage $V_{com}$ from interference, thereby ensuring accuracy of image signal and improving display quality of the display panel.

The present disclosure provides a driving method of a display panel, comprise steps of: applying the drive voltages with opposite polarities to drive the positional corresponding sub-pixels of the two adjacent rows of pixel units, wherein the voltages with opposite polarities comprise voltage with positive polarity and voltage with negative polarity; applying voltages with positive polarity to a part of the positional corresponding sub-pixels of the two adjacent rows of pixel units; applying voltage with negative polarity to the other part of the positional corresponding sub-pixels of the two adjacent rows of pixel units; applying two drive voltages with opposite polarities to drive sub-pixels of the same pixel unit; applying drive voltages with at least two voltage levels to drive sub-pixels of the same pixel unit, and separating the plurality of sub-pixels according to the drive voltages with voltage levels.

In one of embodiments, the pixel unit comprises a first sub-pixel, a second sub-pixel, a third sub-pixel and a fourth sub-pixel arranged sequentially, and the step of applying the two drive voltages with opposite polarities to drive the sub-pixels of the same pixel unit, comprises steps of: applying drive voltage with first polarity to drive the first sub-pixel and the fourth sub-pixel of the same pixel unit; applying drive voltage with second polarity to drive the second sub-pixel and the third sub-pixel of the same pixel unit; wherein the first polarity and the second polarity are opposite to each other.

In one of embodiments, the step of applying the two drive voltages with opposite polarities to drive the sub-pixels of the same pixel unit, comprises steps of: applying drive voltages with opposite polarities to drive each two adjacent sub-pixels of the same pixel unit, wherein the drive voltages with opposite polarities comprise the first positive polarity drive voltage and the first negative polarity drive voltage; applying drive voltage with positive polarity to one of the two sub-pixels, and applying drive voltage with negative polarity to the other of the two sub-pixels.

In one of embodiments, the pixel unit comprises four sub-pixels, and the step of applying the drive voltages with at least two voltage levels to drive the sub-pixels of the same pixel unit, comprises steps of: applying drive voltage with first voltage level to drive two sub-pixel of the pixel unit; and applying drive voltage with second voltage level to drive other two sub-pixel of the pixel unit, wherein a value of the drive voltage with first voltage level is different from a value of the drive voltage with second voltage level.

In one of embodiments, the driving method comprises steps of, within the display time of two adjacent frames, applying the drive voltages with opposite polarities to drive the same sub-pixel, wherein the display time of two adjacent frames comprise the first display time and the second display time; within the first display time, applying drive voltage with third polarity to drive the same sub-pixel; within the second display time, applying drive voltage with fourth polarity to drive the same sub-pixel, wherein the drive voltage with third polarity and the drive voltage with fourth polarity are different in polarity.

The present disclosure further provides a driver device of a display panel, and the driver device comprises: a first driver module applying the drive voltages with opposite polarities to drive the positional corresponding sub-pixels of the two adjacent rows of pixel units; a second driver module applying the two drive voltages with opposite polarities to drive the plurality of sub-pixels of the same pixel unit; a third driver module applying the drive voltages with at least two voltage levels to drive the plurality of sub-pixels of the same pixel unit.

In one of embodiments, the pixel unit comprises a first sub-pixel, a second sub-pixel, a third sub-pixel and a fourth sub-pixel arranged sequentially, and sizes of the first sub-pixel, the second sub-pixel, the third sub-pixel and the fourth sub-pixel are the same. The second driver module comprises: a first driving unit applying the drive voltage with first polarity to drive the first sub-pixel and the fourth sub-pixel of the same pixel unit; a second driving unit applying the drive voltage with second polarity to drive the second sub-pixel and the third sub-pixel of the same pixel unit, wherein the first polarity and the second polarity are opposite to each other.

In one of embodiments, the second driver module comprises: a third driving unit applying the drive voltages with opposite polarities to drive each two adjacent sub-pixels of the same pixel unit, wherein the drive voltages with opposite polarities comprise the drive voltage with third polarity and the drive voltage with fourth polarity, and the drive voltage with third polarity and the drive voltage with fourth polarity are different in polarity; wherein, within the first driving time, the third driving unit applies the drive voltage with third polarity to drive the two adjacent sub-pixels of the same pixel unit, and within the second driving time, the third driving unit applies the drive voltage with fourth polarity to drive the two adjacent sub-pixels of the same pixel unit.

In one of embodiments, the pixel unit comprises four sub-pixels, and the third driver module comprises: a fourth driving unit applying drive voltage with first voltage level to drive two sub-pixels of the pixel unit; a fifth driving unit applying drive voltage with second voltage level to drive the other two sub-pixels of the pixel unit, wherein the value of the drive voltage with first voltage level is higher than or lower than the value of the drive voltage with second voltage level.

The present disclosure further provides other driving method of a display panel, and the driving method comprises steps of: applying the drive voltages with opposite polarities to drive the positional corresponding sub-pixels of the two adjacent rows of pixel units, wherein the voltages with opposite polarities comprise the voltage with positive polarity and the voltage with negative polarity; applying voltage with positive polarity to a part of the positional corresponding sub-pixels of the two adjacent rows of pixel units; applying voltage with negative polarity to the other part of the positional corresponding sub-pixels of the two adjacent rows of pixel units; and the step of applying the two drive voltages with opposite polarities to drive the sub-pixels of the same pixel unit, comprises steps of: applying drive voltages with opposite polarities to drive each two adjacent sub-pixels of the same pixel unit, wherein the drive voltages with opposite polarities comprise the first positive polarity drive voltage and the first negative polarity drive voltage, and the first positive polarity drive voltage is applied to one of two sub-pixel, the first negative polarity drive voltage is applied to the other of two sub-pixel; separating the plurality of sub-pixel of the display panel into the first voltage level sub-pixel and the second voltage level sub-pixel, wherein the first voltage level sub-pixel and the second voltage level sub-pixel are disposed alternately in the display panel; applying drive voltage with first voltage level to drive the first voltage level sub-pixel; applying drive voltage with second voltage level to drive the second voltage level sub-pixel, wherein the drive voltage with first voltage level is different from the drive voltage with second voltage level.

The present disclosure further provides other driver device of a display panel, and the device comprises: a first driver module applying the drive voltages with opposite polarities to drive the positional corresponding sub-pixels of the two adjacent rows of pixel units; a second driver module applying the two drive voltages with opposite polarities to drive the plurality of sub-pixels of the same pixel unit; a grouping module separating the sub-pixels of the display panel into the first voltage level sub-pixel and the second voltage level sub-pixel, wherein the first voltage level sub-pixel and the second voltage level sub-pixel are disposed alternately in the display panel; a third driver module applying the drive voltage with first voltage level to drive the first voltage level sub-pixel, and applying the drive voltage with second voltage level to drive the second voltage level sub-pixel.

According to an embodiment, the present disclosure further provides a display device including a display panel and one of above-mentioned driver devices.

According to the driving method of the display panel and the driver device thereof, the number of the same color sub-pixels applied by the high voltage-level drive voltage with positive polarity, in each column, can be the same as the number of the same color sub-pixels applied by the high voltage-level drive voltage with negative polarity, so as to prevent the common electrode voltage $V_{com}$ from being affected by the parasitic capacitance, thereby ensuring accuracy of the image signal, prevent the color shift or abnormal picture quality.

BRIEF DESCRIPTION OF THE DRAWINGS

The structure, operating principle and effects of the present disclosure will be described in detail by way of various embodiments which are illustrated in the accompanying drawings.

FIG. 2 is a schematic view of drive voltages of a plurality of pixel units in a display panel of an embodiment of the present disclosure.

FIG. 3 is a schematic view of drive voltages of sub-pixels of a plurality of pixel units of a display panel of an embodiment of the present disclosure.

FIG. 4 is a schematic view of drive voltages of sub-pixels of a plurality of pixel units of a display panel of other embodiment of the present disclosure.

DETAILED DESCRIPTION OF THE PREFERRED EMBODIMENTS

Figure 1:
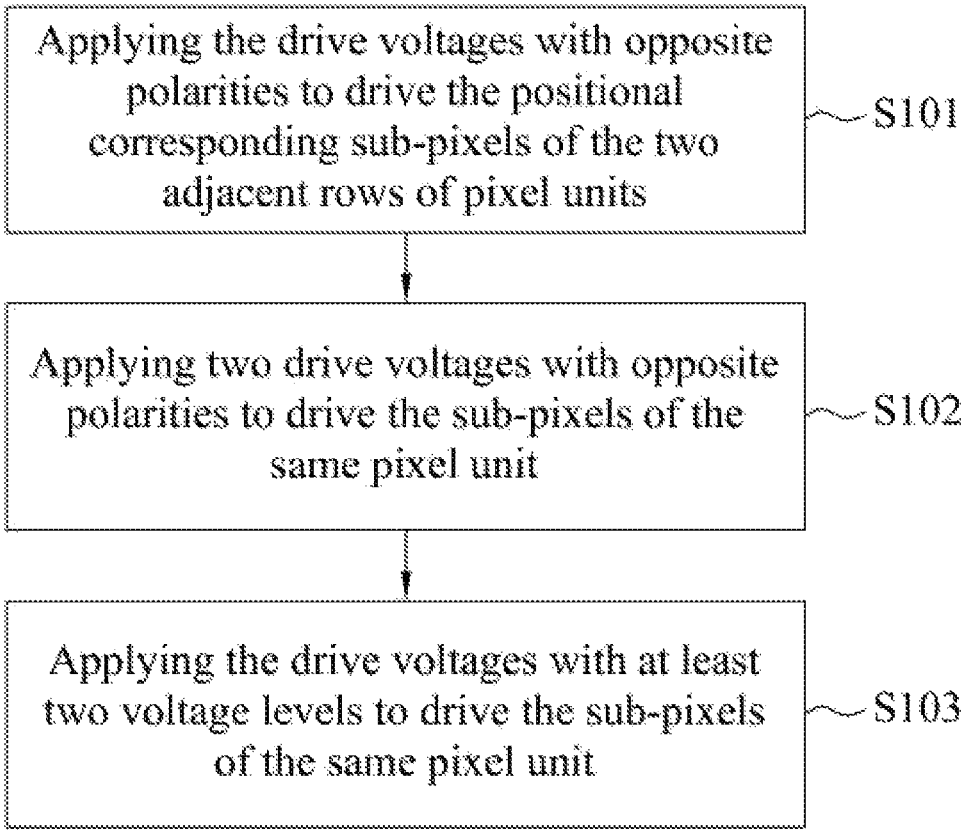
FIG. 1 is a flow chart of a driving method of a display panel of an embodiment of the present disclosure.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

For example, the present disclosure provides a driving method of a display panel, comprise steps of: applying the drive voltages with opposite polarities to drive the positional corresponding sub-pixels of the two adjacent rows of pixel units, wherein the voltages with opposite polarities comprise voltage with positive polarity and voltage with negative polarity; applying voltages with positive polarity to a part of the positional corresponding sub-pixels of the two adjacent rows of pixel units; applying voltage with negative polarity to the other part of the positional corresponding sub-pixels of the two adjacent rows of pixel units; applying two drive voltages with opposite polarities to drive sub-pixels of the same pixel unit; applying drive voltages with at least two voltage levels to drive sub-pixels of the same pixel unit, and separating the plurality of sub-pixels according to the drive voltages with voltage levels.

For example, the present disclosure further provides a driver device of a display panel, and the driver device comprises: a first driver module applying the drive voltages with opposite polarities to drive the positional corresponding sub-pixels of the two adjacent rows of pixel units; a second driver module applying the two drive voltages with opposite polarities to drive the plurality of sub-pixels of the same pixel unit; a third driver module applying the drive voltages with at least two voltage levels to drive the plurality of sub-pixels of the same pixel unit.

For example, the present disclosure further provides other driving method of a display panel, and the driving method comprises steps of: applying the drive voltages with opposite polarities to drive the positional corresponding sub-pixels of the two adjacent rows of pixel units, wherein the voltages with opposite polarities comprise the voltage with positive polarity and the voltage with negative polarity; applying voltage with positive polarity to a part of the positional corresponding sub-pixels of the two adjacent rows of pixel units; applying voltage with negative polarity to the other part of the positional corresponding sub-pixels of the two adjacent rows of pixel units; and the step of applying the two drive voltages with opposite polarities to drive the sub-pixels of the same pixel unit, comprises steps of: applying drive voltages with opposite polarities to drive each two adjacent sub-pixels of the same pixel unit, wherein the drive voltages with opposite polarities comprise the first positive polarity drive voltage and the first negative polarity drive voltage, and the first positive polarity drive voltage is applied to one of two sub-pixel, the first negative polarity drive voltage is applied to the other of two sub-pixel; separating the plurality of sub-pixel of the display panel into the first voltage level sub-pixel and the second voltage level sub-pixel, wherein the first voltage level sub-pixel and the second voltage level sub-pixel are disposed alternately in the display panel; applying drive voltage with first voltage level to drive the first voltage level sub-pixel; applying drive voltage with second voltage level to drive the second voltage level sub-pixel, wherein the drive voltage with first voltage level is different from the drive voltage with second voltage level.

For example, the present disclosure further provides other driver device of a display panel, and the device comprises: a first driver module applying the drive voltages with opposite polarities to drive the positional corresponding sub-pixels of the two adjacent rows of pixel units; a second driver module applying the two drive voltages with opposite polarities to drive the plurality of sub-pixels of the same pixel unit; a grouping module separating the sub-pixels of the display panel into the first voltage level sub-pixel and the second voltage level sub-pixel, wherein the first voltage level sub-pixel and the second voltage level sub-pixel are disposed alternately in the display panel; a third driver module applying the drive voltage with first voltage level to drive the first voltage level sub-pixel, and applying the drive voltage with second voltage level to drive the second voltage level sub-pixel.

For example, the present disclosure further provides a display device including a display panel and one of above-mentioned driver devices.

The display panel comprises a plurality of pixel units distributed in a matrix form, for example, the display panel can comprise a plurality of first pixel units and a plurality of second pixel units disposed adjacent to each other. The pixel unit comprise the sub-pixels, for example, each pixel unit at least includes the red sub-pixel, the green sub-pixel and the blue sub-pixel; optionally, each pixel unit can include the white sub-pixel.

The following describes a driving method of a display panel and a driver device thereof, in cooperation with figures.

Please refer to FIGS. 1 and 2. FIG. 1 is a flow chart of a driving method of a display panel of an embodiment of the present disclosure. The driving method can be applied to the display panel. As shown in FIG. 1, the driving method 10 includes steps S101 through S104:

The step S101 is a step of applying the drive voltages with opposite polarities to drive the positional corresponding sub-pixels of the two adjacent rows of pixel units.

As shown in FIG. 2, the display panel 20 comprises a plurality of pixel units distributes in a matrix form, the pixel unit comprise sub-pixels, for example, each pixel unit comprises the plurality of sub-pixels with different color, for example, each pixel units comprises three sub-pixels, such as a red (R) sub-pixel, a green (G) sub-pixel and blue (B) sub-pixel. Alternatively, each pixel unit can comprise four sub-pixels, such as the R sub-pixel, the G sub-pixel, the B sub-pixel and a white (W) sub-pixel.

In an embodiment, the sub-pixels of the display panel are applied by the drive voltages, respectively, so that the drive voltages with opposite polarities can be applied to the positional corresponding sub-pixels of the two adjacent rows of pixel units.

The positional correspondence means that the relative positions or the arrangement sequence of the sub-pixels in a row of pixel unit are the same; for example, each pixel unit comprises the first sub-pixel, the second sub-pixel, the third sub-pixel and the fourth sub-pixel arranged in a sequential order, and among two adjacent rows of pixel units, the two first sub-pixels in the same column are the positional corresponding sub-pixels; the two second sub-pixel in the same column are the positional corresponding sub-pixels; the two third sub-pixel in the same column are the positional corresponding sub-pixels; the two fourth sub-pixel in the same column are the positional corresponding sub-pixels. Optionally, the aforementioned sequence order can be an order from left to right, an order from right to left, an order from top to bottom, or an order from bottom to top.

The step S102 is a step of applying two drive voltages with opposite polarities to drive the sub-pixels of the same pixel unit.

In an embodiment, when each pixel unit comprises three sub-pixels, the drive voltage with positive polarity is applied to one of the three sub-pixels, the drive voltages with negative polarity are applied to the other two sub-pixels; alternatively, the drive voltage with negative polarity is applied to one of the sub-pixels, the drive voltages with positive polarity are applied to the other two sub-pixel.

In an embodiment, when each pixel units comprises 4 sub-pixels, two sub-pixels are applied by the drive voltages with positive polarity, and the drive voltages with negative polarity are applied to the other two sub-pixel. Optionally, each two adjacent sub-pixels are applied by the drive voltages with opposite polarities, respectively; alternatively, the two sub-pixels at the central location are applied by the drive voltage with first polarity, and the two sub-pixels at the edge locations are applied by the drive voltage with second polarity. For example, the pixel unit comprises the first sub-pixel, the second sub-pixel, the third sub-pixel and the fourth sub-pixel arranged sequentially, and particularly, the step S102 can comprise steps of: applying the drive voltage with first polarity to drive the first sub-pixel and the fourth sub-pixel of the same pixel unit; applying the drive voltage with second polarity to drive the second sub-pixel and the third sub-pixel of the same pixel unit. The first polarity and the second polarity are opposite to each other. For example, when the first polarity is positive polarity, the second polarity is negative polarity; or, when the first polarity is negative polarity, the second polarity is positive polarity. Among the same color sub-pixels of each pixel unit, the number of the sub-pixel with positive polarity is the same as the number of the sub-pixels with negative polarity, so as to ensure that the number of the high voltage sub-pixel with positive polarity is the same as the number of the high voltage sub-pixel with negative polarity in each column of pixels in the display panel, thereby ensuring the accuracy of the image signal and preventing color shift problem or abnormal picture quality problem.

In the embodiment of the present disclosure, the drive voltage with positive polarity means that the drive voltage is higher than the preset common electrode voltage $V_{com}$ of the display panel, and the voltage difference between the drive voltage and the voltage $V_{com}$ is higher than zero; The drive voltage with negative polarity means that the drive voltage is lower than the voltage $V_{com}$, and the voltage difference between the drive voltage and the voltage $V_{com}$ is lower than zero.

The step S103 is a step of applying the drive voltages with at least two voltage levels to drive the sub-pixels of the same pixel unit.

At least two voltage levels comprise the first voltage level and the second voltage level, and the first voltage level can be higher than or lower than the second voltage level. For example, the first voltage level is the high voltage level, the second voltage level is the low voltage level; alternatively, the first voltage level is the low voltage level, and the second voltage level is the high voltage level.

In an embodiment, the drive voltages with first voltage level and second voltage level are applied to drive each two adjacent sub-pixels of the same pixel unit, and the drive voltage levels of each two adjacent sub-pixels of the same pixel unit are different.

In an embodiment, the pixel unit comprise the four sub-pixels, the two adjacent sub-pixels are set as a group, and the drive voltages with first voltage level and second voltage level are applied to drive each adjacent two groups of sub-pixels of the same pixel unit, so that the drive voltage level of the two groups of sub-pixels of the same pixel unit are different.

In an embodiment, the drive voltages with the first voltage level and second voltage level are applied to drive each two adjacent sub-pixels of the display panel, so that the drive voltage level of each two adjacent sub-pixels of the display panel are different.

In an embodiment, each pixel unit comprises three or four sub-pixels, the adjacent two sub-pixels are set as a group, the drive voltages with the first voltage level and second voltage level are applied to drive each adjacent two groups of the sub-pixel of the display panel, so that the drive voltage levels of the two groups of the sub-pixel of the display panel are different.

Particularly, the driving method of the display panel comprises steps of separating the sub-pixels of the display panel into the high voltage sub-pixels and the low voltage sub-pixels; applying the high voltage level drive voltages to drive the high voltage sub-pixels; apply the low voltage level drive voltages to drive the low voltage sub-pixels. The high voltage sub-pixels and the low voltage sub-pixels are disposed alternately, that is, no matter in row or column direction, the sub-pixel adjacent to the high voltage sub-pixel is always the low voltage sub-pixel, the sub-pixel adjacent to the low voltage sub-pixel is always the high voltage sub-pixel; alternatively, each two high voltage sub-pixels and each two low voltage sub-pixels are disposed alternately; or, each two high voltage sub-pixels and each two low voltage sub-pixels are disposed alternately in a first direction, and each high voltage sub-pixels and a low voltage sub-pixel are disposed alternately in a second direction. The second direction is perpendicular to the first direction, and the first direction means the arrangement direction of the plurality of sub-pixels of the pixel unit.

The high voltage level means that the inputted drive voltage of the sub-pixel is higher than the preset voltage value corresponding to the grayscale of the sub-pixel. Similarly, the low voltage level means that the inputted drive voltage of the sub-pixel is lower than the preset voltage value corresponding to the grayscale of the sub-pixel. In order to drive a sub-pixel normally to display grayscale in a range of 0 to 255, the drive voltage in a range of V0 to V255 must be inputted into the sub-pixel. In this embodiment, the first drive voltage level corresponding to the first pixel unit is high voltage level, and the second drive voltage level corresponding to the second pixel unit is low voltage level; for example, the preset voltage value $V_k$ corresponds to the grayscale K of the sub-pixel ($0 \leq k \leq 255$, k is an integer), and the sub-pixels of the first pixel unit is inputted by the drive voltage higher than Vk, and the sub-pixels of the second pixel unit are inputted by the drive voltage lower than Vk.

The high voltage sub-pixels and the low voltage sub-pixels are disposed alternately in the display panel, and the voltage levels of the drive voltages applied to each two adjacent sub-pixels are different, or, the voltage levels of the drive voltages applied every multiple sub-pixels are changed, so that the grayscale-brightness curve of the pixel unit under the side view angle can approach to the grayscale-brightness curve under the front view angle, thereby improving the color shift problem under the side view angle.

The row and column of the embodiment of the present disclosure indicates two arrangement directions perpendicular to each other, for example, the row indicates a longitudinal direction and the column indicates a horizontal direction; alternatively, the row direction can indicate the horizontal direction and the column can indicate the longitudinal direction. That is, the "row" of the embodiment of the present disclosure can be the "column" for one of ordinary skill in the art, and the "column" of the embodiment of the present disclosure can be the "row" for one of ordinary skill in the art.

In actual application, the steps S101, S102 and S103 can be performed simultaneously. That is, the drive voltages are applied to the sub-pixels of the display panel, so that the drive voltages with opposite polarities can be applied to the positional corresponding sub-pixels of the two adjacent rows of pixel units, the polarities of the drive voltages applied to the sub-pixels of the same pixel unit are not fully the same, and the drive voltage levels of the plurality of sub-pixels of the same pixel unit are not fully the same. The voltage levels of the drive voltages of each two adjacent pixel units are different, to solve the color shift problem under the side view angle; furthermore, among each column (row) of same-color pixels in the display panel, the number of the sub-pixels applied by the high voltage level drive voltages with positive polarity is the same as the number of the sub-pixels applied by the high voltage level drive voltages with negative polarity, so as to prevent the voltage $V_{com}$ from being affected by parasitic capacitance, thereby ensuring the accuracy of the image signal and preventing color shift problem or abnormal picture quality problem.

In an embodiment, before the sub-pixels of the display panel are applied by the drive voltages, the driving method of the display panel further comprises steps of: obtaining the image data inputted externally, and determining the grayscale data of each sub-pixel of display panel according to the image data. In the step S104, the drive voltage corresponding to each sub-pixel is generated according to the grayscale data of each sub-pixel and the voltage level corresponding to each sub-pixel, and the generated drive voltages are applied to drive the sub-pixels of the first pixel unit and the sub-pixels of the second pixel unit, respectively.

Please refer to FIGS. 2 and 3. P indicates the pixel unit, (i, j) indicates the i-th column and j-th row, (i, j+1) indicates the i-th column and (j+1)th row, (i+1, j) indicates the (i+1)th column and j-th row, and so on; or vice versa. For example, when each pixel units comprises the red sub-pixel, the green sub-pixel, the blue sub-pixel and the white sub-pixel, R represent the red sub-pixel, G represent the green sub-pixel, B represent the blue sub-pixel, and W represent the white sub-pixel. H indicates the first drive voltage level, and L indicates the second drive voltage level.

According to the step S101, the drive voltages with opposite polarities are applied to drive the positional corresponding sub-pixels of the two adjacent rows of pixel units. As shown in FIG. 3, the pixel unit comprises the first sub-pixel, the second sub-pixel, the third sub-pixel and the fourth sub-pixel arranged sequentially, which are the R sub-pixel, the G sub-pixel, the B sub-pixel and the W sub-pixel, respectively. The j-th row of the pixel units and the (j+1)th row of pixel units adjacent to each other are taken as example, the two first sub-pixels R (i, j) and R(i, j+1) of the i-th column of the two rows of pixel units are applied by the drive voltages with opposite polarities; the two second sub-pixels G (i, j) and G (i, j+1) of the i-th column of the two rows of the pixel unit are applied by the drive voltages with opposite polarities; the two first sub-pixels R (i+1, j) and R (i+1, j+1) in the (i+1)th column of two rows of pixel units are applied by the drive voltages with opposite polarities, and so on. As a result, the drive voltages with opposite polarities are applied to the two positional corresponding sub-pixels of each two adjacent rows of pixel units.

According to the step S102, the two drive voltages with opposite polarities are applied to drive the sub-pixels of the same pixel unit. As shown in FIG. 3, the j-th row and i-th column of the pixel unit P1 (i, j) is taken as example. Within the display time of frame image, wherein, first sub-pixel R (i, j) and the fourth sub-pixel W1 (i, j) are applied by the drive voltage with positive polarity, the first sub-pixel G (i, j) and the third sub-pixel B (i, j) are applied by the drive voltage with negative polarity, so that the drive voltages of the plurality of sub-pixels of the same pixel unit are not fully the same.

According to the step S103, the drive voltages with at least two voltage levels are applied to drive the sub-pixels of the same pixel unit. For example, when each pixel unit comprises the four sub-pixels, the step S103 comprises steps of: applying the drive voltage with first voltage level to drive two sub-pixels of the pixel unit; and applying the drive voltage with second voltage level to drive other two sub-pixels of the pixel unit.

For example, the drive voltage levels of each two adjacent sub-pixels are different, as shown in FIG. 3, the sub-pixels adjacent to the j-th row and i-th column of R sub-pixel comprise the j-th row and (i+1)th column of R sub-pixel and the j-th row and i-th column of G sub-pixel, and when the j-th row and i-th column of R sub-pixel is applied the drive voltage with H level, the j-th row and (i+1)th column of R sub-pixel and the j-th row and i-th column of G sub-pixel are applied by the drive voltages with L level, so that the drive voltage levels of each two adjacent sub-pixels are different.

By using aforementioned driving method, among the same color sub-pixels in each column (or row) of pixels in the liquid crystal panel, the number of sub-pixels applied by the high voltage level (H+) drive voltages with positive polarity is the same as the number of sub-pixels applied by the high voltage level (H−) drive voltages with negative polarity, such as each column of sub-pixels shown in FIG. 3, the number of the R sub-pixels applied by the high voltage level (H+) drive voltage with positive polarity is two, and the number of the R sub-pixels applied by the high voltage level (H−) drive voltage with negative polarity is also two. The number of high voltage level sub-pixels with positive polarity equal to the number of high voltage level sub-pixels with negative polarity can prevent the voltage $V_{com}$ from being affected by parasitic capacitance, thereby ensuring the accuracy of the image signal and preventing color shift problem or abnormal picture quality problem.

In an embodiment, the driving method comprises steps of: apply the drive voltages with the same polarity to drive the same column of sub-pixels. As shown in FIG. 3, the j-th row of the R sub-pixels are applied by the drive voltage with positive polarity, the j-th row of the G sub-pixel are applied by the drive voltage with negative polarity, the j-th row of the B sub-pixel are applied by the drive voltage with negative polarity, and the j-th row of the W sub-pixel are applied by the drive voltage with positive polarity. The polarities of the drive voltages applied to the same column of sub-pixels are the same, so that the voltage difference of the voltage signals outputted from the same data line can be limited to a smaller range, thereby preventing the data driver chip from generating too much heat or preventing from voltage signal distortion, to improve the display quality of sub-pixel.

In an embodiment, when aforementioned display panel is a liquid crystal panel, the manner of applying DC electric field to drive liquid crystal pixel may cause chemical reaction of liquid crystal material to accelerate electrode aging and reduce lifetime of the liquid crystal panel. For this reason, the sub-pixels of the display panel are driven by AC electric field, in order to protect the liquid crystal material and electrode and extend the lifetime of the display panel. In an embodiment, the driving method comprises a step of, within the display time of two adjacent frames, applying the drive voltages with opposite polarities to drive the same sub-pixel; that is, within the display time of two adjacent frames, the drive voltages with opposite polarities are applied to the sub-pixels, so as to achieve the AC driving effect. The display time of two adjacent frames comprise the first display time and the second display time, within the first display time, the drive voltage with third polarity is applied to drive the same sub-pixel, and within the second display time, the drive voltage with fourth polarity is applied to drive the same sub-pixel. The drive voltage with third polarity and the drive voltage with fourth polarity have the same voltages value but opposite polarities. For example, within display time of the m-th frame, the sub-pixels are applied by the drive voltages shown in FIG. 3, and within display time of the (m+1)th frame, the sub-pixels are applied by the drive voltages shown in FIG. 4. As a result, the polarity of the drive voltage applied to the same sub-pixel is changed and the drive voltage level does not changed within the display time two adjacent frames. That is, the AC driving manner for each sub-pixel can be implemented to protect the liquid crystal materials and electrodes, and extend the lifetime of liquid crystal display panel.

Figure 5:
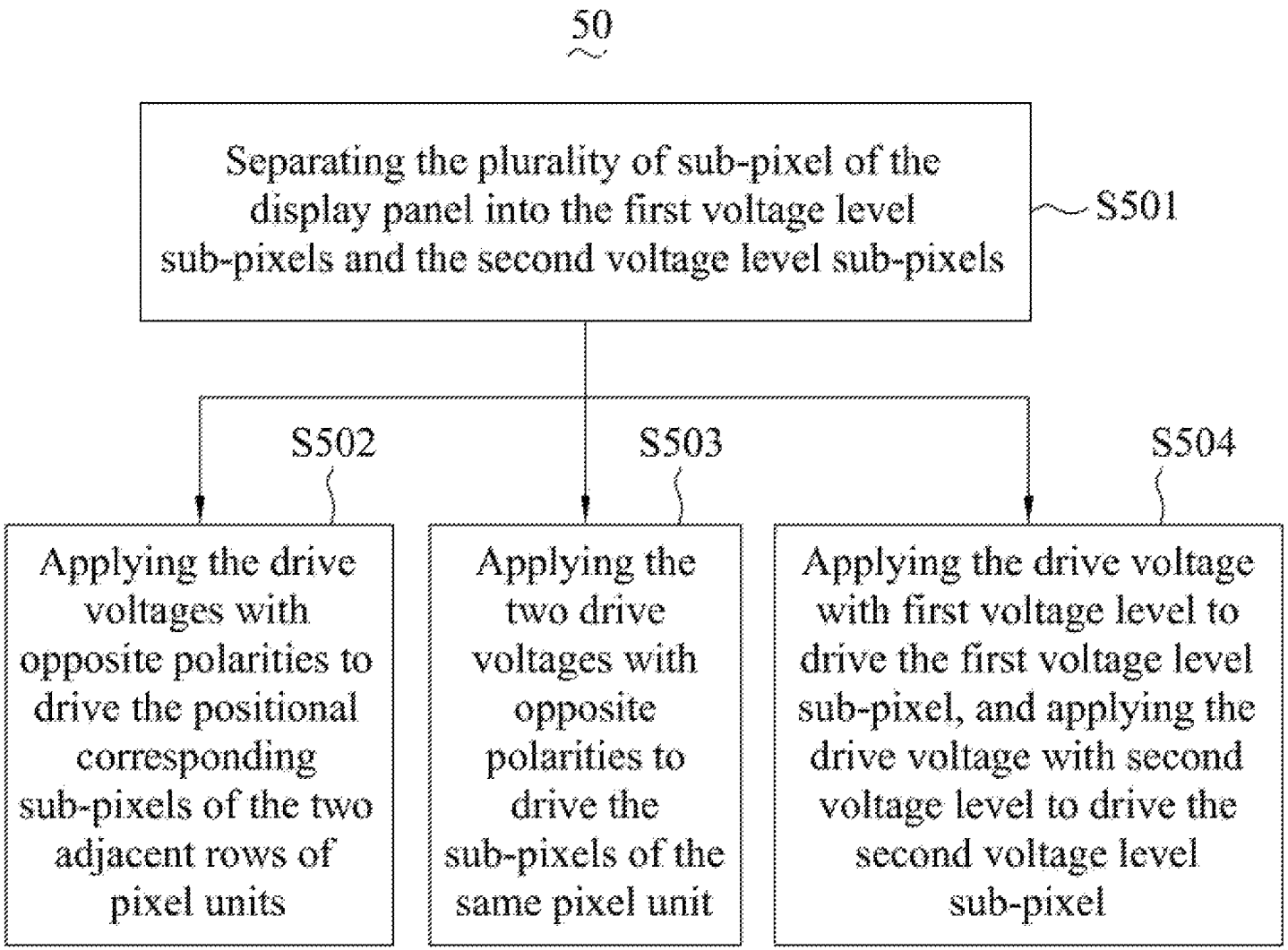
FIG. 5 is a flow chart of a driving method of a display panel of other embodiment of the present disclosure.

Please refer to FIG. 5. FIG. 5 is a flow chart of a driving method of a display panel of another embodiment of the present disclosure. The driving method 50 comprises steps S501 through S504.

The step S501 is a step of separating the plurality of sub-pixel of the display panel into the first voltage level sub-pixels and the second voltage level sub-pixels.

The first voltage level sub-pixels and the second voltage level sub-pixels are disposed alternately in the display panel.

The step S502 is a step of applying the drive voltages with opposite polarities to drive the positional corresponding sub-pixels of the two adjacent rows of pixel units.

The step S503 is a step of applying the two drive voltages with opposite polarities to drive the sub-pixels of the same pixel unit.

The particular implementation for the steps S502 and S503 can refer to the implementation of the steps S101 and S102 shown in FIGS. 1 to 4, so the detailed descriptions are not repeated.

The step S504 is a step of applying the drive voltage with first voltage level to drive the first voltage level sub-pixel, and applying the drive voltage with second voltage level to drive the second voltage level sub-pixel.

In an embodiment, the steps S502, S503 and S504 can be performed simultaneously, for example, within the display time of the same frame image, the sub-pixel of the display panel are applied by the drive voltages, respectively, so that the drive voltages with opposite polarities can be applied to the positional corresponding sub-pixels of the two adjacent rows of pixel units, the plurality of sub-pixels of the same pixel unit are applied by the two drive voltages with opposite polarities. The drive voltage level of the first voltage level sub-pixel is first voltage level, and the drive voltage level of the second first voltage level sub-pixel is second voltage level.

In an embodiment, the first voltage level and the second voltage level are high voltage level and low voltage level, respectively. Particularly, the method is to separate the sub-pixel of the display panel into the high voltage sub-pixel and the low voltage sub-pixel, apply the high voltage level drive voltages to drive the high voltage sub-pixel, and apply the low voltage level drive voltages to drive the low voltage sub-pixel. The high voltage sub-pixels and the low voltage sub-pixel are disposed alternately, that is, no matter in row or column direction, the sub-pixel adjacent to the high voltage sub-pixel is always the low voltage sub-pixel, and the sub-pixel adjacent to the low voltage sub-pixel is always the high voltage sub-pixel; alternatively, each two high voltage sub-pixels and each two low voltage sub-pixels are disposed alternately; or, each two high voltage sub-pixels and each two low voltage sub-pixels are disposed alternately in a first direction, and each high voltage sub-pixel and a low voltage sub-pixel are disposed alternately in a second direction. The second direction is perpendicular to the first direction, and the first direction means the arrangement direction of the plurality of sub-pixels of the pixel unit.

The high voltage sub-pixels and the low voltage sub-pixels are disposed alternately in the display panel, and the voltage levels of the drive voltages applied to each two adjacent sub-pixels are different, or, the voltage levels of the drive voltages applied every multiple sub-pixel are changed, so that the grayscale-brightness curve of the pixel unit under the side view angle can approach to the grayscale-brightness curve under the front view angle, thereby improving the color shift problem under the side view angle; furthermore, when the image shown by the high voltage sub-pixels and the low voltage sub-pixels is viewed by the front view angle or the side view angle, the user can view the image with the same color level.

In an embodiment, when the display panel is driven, after the voltage level and polarity of the drive voltage for each sub-pixel is determined, the drive voltage for each sub-pixel is obtained according to the image data of each sub-pixel and the polarity and voltage level of the drive voltage corresponding to the sub-pixel, and the drive voltages are applied to the sub-pixels through the data line.

The embodiment of the present disclosure further provides a driver device 60 of a display panel. The display panel comprises a plurality of pixel units distributes in a matrix form, the pixel unit comprise the sub-pixels, for example, each pixel unit comprises the R sub-pixel, the G sub-pixel and the B sub-pixel; or, each pixel unit comprises the R sub-pixel, the G sub-pixel, the B sub-pixel and W sub-pixel.

Figure 6:
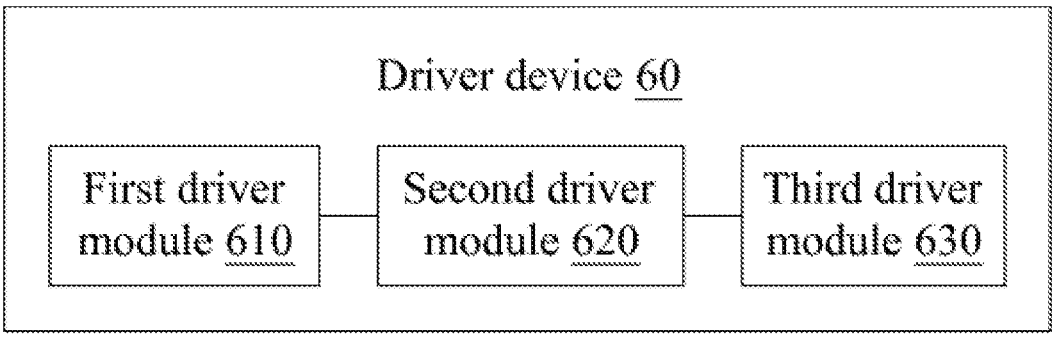
FIG. 6 is a schematic structural view of a driver device of a display panel of an embodiment of the present disclosure.

As shown in FIG. 6, the driver device 60 comprises a first driver module 610, a second driver module 620 and a third driver module 630. The first driver module 610 applies the drive voltages with opposite polarities to drive the positional corresponding sub-pixels of each two adjacent rows of pixel units. The second driver module 620 applies the two drive voltages with opposite polarities to drive the plurality of sub-pixels of the same pixel unit. The third driver module 630 applies the drive voltages with at least two voltage levels to drive the plurality of sub-pixels of the same pixel unit. The voltage levels of the drive voltages of each two adjacent the pixel units are different, to solve the color shift problem under the side view angle, so that among the same color sub-pixels of each column (or row) pixels of the display panel, the number of the sub-pixel applied by the high voltage level drive voltages with positive polarity is the same as the number of the sub-pixel applied by the high voltage level drive voltages with negative polarity, thereby preventing the voltage $V_{com}$ from being affected by parasitic capacitance, and ensuring the accuracy of the image signal and preventing color shift problem or abnormal picture quality problem.

In one of embodiments, the pixel unit comprises the first sub-pixel, the second sub-pixel, the third sub-pixel and the fourth sub-pixel, arranged sequentially. As shown FIG. 7, the second driver module 620 comprise a first driving unit 621 and a second driving unit 622, the first driving unit 621 applies the drive voltage with first polarity to drive the first sub-pixel and the fourth sub-pixel of the same pixel unit, and the second driving unit 622 applies the drive voltage with second polarity to drive the second sub-pixel and the third sub-pixel of the same pixel unit. The first polarity and the second polarity are opposite to each other. In each pixel unit, the number of sub-pixels with positive polarity is the same as the number of the sub-pixels with negative polarity, to ensure that, among each column of the same color sub-pixels, the number of the high voltage sub-pixels with positive polarity is the same as the high voltage sub-pixels with negative polarity, thereby ensuring the accuracy of the image signal and preventing color shift problem or abnormal picture quality problem.

In one of embodiments, the second driver module 620 comprises the third driving unit applying the drive voltages with opposite polarities to drive each two adjacent sub-pixels of the same pixel unit. The drive voltages with opposite polarities comprise the drive voltage with third polarity and the drive voltage with fourth polarity, the drive voltage with third polarity and the drive voltage with fourth polarity are different in polarity. Within the first driving time, the third driving unit applies the drive voltage with third polarity to drive the two adjacent sub-pixels of the same pixel unit, and within the second driving time, the third driving unit applies the drive voltage with fourth polarity to drive the two adjacent sub-pixels of the same pixel unit.

Figure 8:
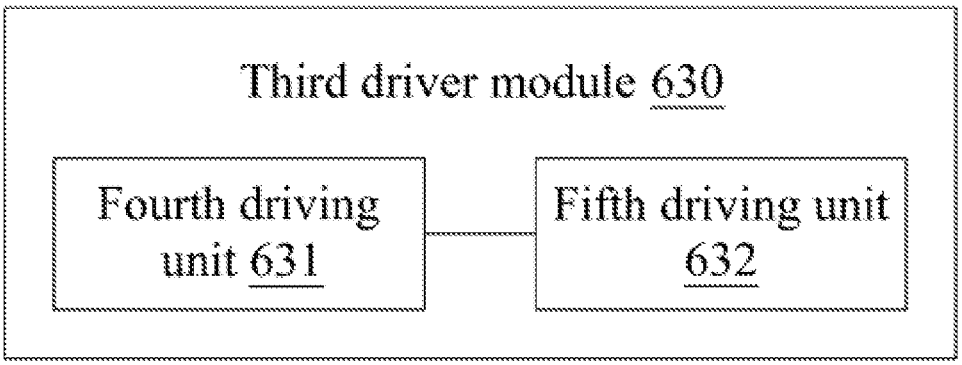
FIG. 8 is a schematic structural view of a second driver module of a driver device of an embodiment of the present disclosure.

When the pixel unit comprises even-number of sub-pixels, for example, the pixel unit may comprise the R sub-pixel, the G sub-pixel, the B sub-pixel and the W sub-pixel, in each pixel unit, the number of the sub-pixel with positive polarity is the same as the number of the sub-pixel with negative polarity, to ensure that, among each column of the same color the sub-pixel, the number of the high voltage sub-pixel with positive polarity is the same as the high voltage sub-pixel with negative polarity, thereby ensuring the accuracy of the image signal and preventing color shift problem or abnormal picture quality problem. In one of embodiments, as shown in FIG. 8, the pixel unit comprise the four sub-pixels, and the third driver module 630 comprises: a fourth driving unit 631 applying the drive voltage with first voltage level to drive two sub-pixel of the pixel unit; and a fifth driving unit 632 applying the drive voltage with second voltage level to drive other two sub-pixel of the pixel unit.

In one of embodiments, the driver device 60 comprises a fourth driver module applying the drive voltages with the same polarity to drive the same column of the sub-pixel. The polarities of the drive voltages applied to the same column of the sub-pixel are the same, so that the voltage difference of the voltage signals outputted from the same data line can be limited to a smaller range, thereby preventing the data driver chip from generating too much heat or prevent from voltage signal distortion, to improve the display quality of the sub-pixel.

In one of embodiments, the driver device 60 comprises a fifth driver module, within the display time of two adjacent frames, applying the drive voltages with opposite polarities to drive the same sub-pixel, so as to drive the sub-pixels by AC field, thereby protecting liquid crystal material and electrodes.

Figure 9:
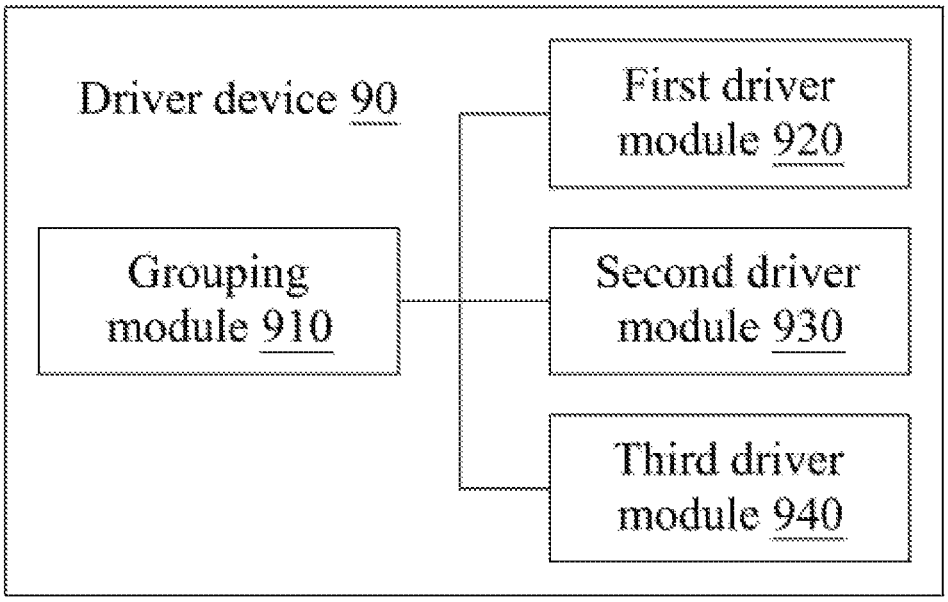
FIG. 9 is a schematic structural view of a driver device of a display panel of another embodiment of the present disclosure.

Please refer to FIG. 9. FIG. 9 is a schematic structural view of a driver device of a display panel of another embodiment of the present disclosure. The driver device 90 comprises a grouping module 910, a first driver module 920, a second driver module 930 and a third driver module 940.

The grouping module 910 can separate the plurality of sub-pixel of the display panel into the first voltage level sub-pixel and the second voltage level sub-pixel, and the first voltage level sub-pixel and the second voltage level sub-pixel are disposed alternately in the display panel. The first driver module 920 can apply the drive voltages with opposite polarities to drive the positional corresponding sub-pixels of the two adjacent rows of pixel units. The second driver module 930 can apply the two drive voltages with opposite polarities to drive the sub-pixels of the same pixel unit. The third driver module 940 can apply the drive voltage with first voltage level to drive the first voltage level sub-pixel, and apply the drive voltage with second voltage level to drive the second voltage level sub-pixel.

Figure 7:
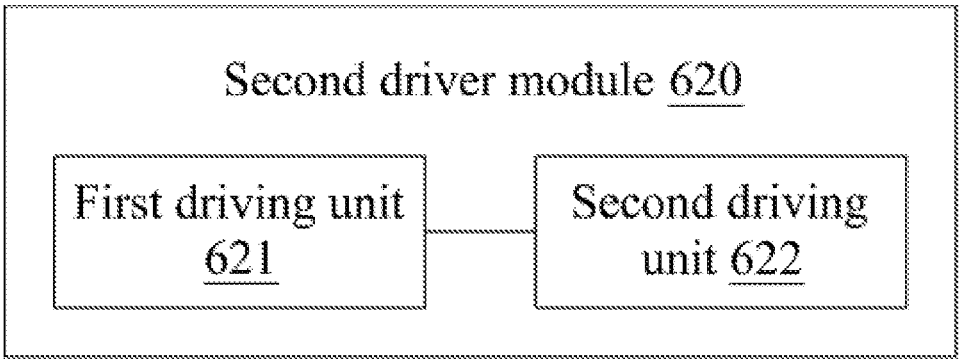
FIG. 7 is a schematic structural view of a first driver module of a driver device of an embodiment of the present disclosure.

The particular embodiment of the first driver module 920 and the second driver module 930 can refer to that of the first driver module 610 and the second driver module 620 of the embodiments shown in FIGS. 6 to 8, so the detailed descriptions are not repeated.

In this embodiment, the first voltage level sub-pixels and the second voltage level sub-pixels are disposed alternately in the display panel.

For example, the first voltage level and the second voltage level are the high voltage level and the low voltage level, respectively. Particularly, the driver device is to separate the sub-pixel of the display panel into the high voltage sub-pixel and the low voltage sub-pixel, apply the high voltage level drive voltages to drive the high voltage sub-pixel, and apply the low voltage level drive voltages to drive the low voltage sub-pixel. The high voltage sub-pixel and the low voltage sub-pixel are disposed alternately, that is, no matter in row or column direction, the sub-pixel adjacent to the high voltage sub-pixel is always the low voltage sub-pixel, and the sub-pixel adjacent to the low voltage sub-pixel is always the high voltage sub-pixel; alternatively, each two high voltage sub-pixel and each two low voltage sub-pixel are disposed alternately; or, each two high voltage sub-pixel and each two low voltage sub-pixel are disposed alternately in a first direction, and each high voltage sub-pixel and a low voltage sub-pixel are disposed alternately in a second direction. The second direction is perpendicular to the first direction, and the first direction means the arrangement direction of the plurality of sub-pixels of the pixel unit.

The high voltage sub-pixel and the low voltage sub-pixel are disposed alternately in the display panel, the voltage levels of the drive voltages applied to each two adjacent sub-pixel are different, or the voltage levels of the drive voltages applied every multiple sub-pixel are changed, so that the grayscale-brightness curve of the pixel unit under the side view angle can approach to the grayscale-brightness curve under the front view angle, thereby improving the color shift problem under the side view angle.

The row and column of the embodiment of the present disclosure indicates two arrangement directions perpendicular to each other, for example, the row indicates a longitudinal direction and the column indicates a horizontal direction; alternatively, the row direction can indicate the horizontal direction and the column can indicate the longitudinal direction. That is, the "row" of the embodiment of the present disclosure can be the "column" for one of ordinary skill in the art, and the "column" of the embodiment of the present disclosure can be the "row" for one of ordinary skill in the art.

The present disclosure further provides alternative embodiment, which is a driver device of a display panel. The driver device can apply the driving method of one of aforementioned embodiments; for example, the driver device can be implemented by the driving method of one of aforementioned embodiments; for example, the driver device can have function modules corresponding to the driving method of one of aforementioned embodiments.

For example, the driving method and the driver device can be applied to a liquid crystal display device, OLED display device, Q LED display device, curved display device, or flexible display device. For example, the liquid crystal display device can be TN LCD device, IPS LCD device, PLS LCD device or MVA LCD device. Aforementioned display panels can be driven by applying logic board of full HD display panel. That is, the driving method and the driver device of aforementioned display panel can be implemented by using the logic board of the full HD display panel.

Figure 10:
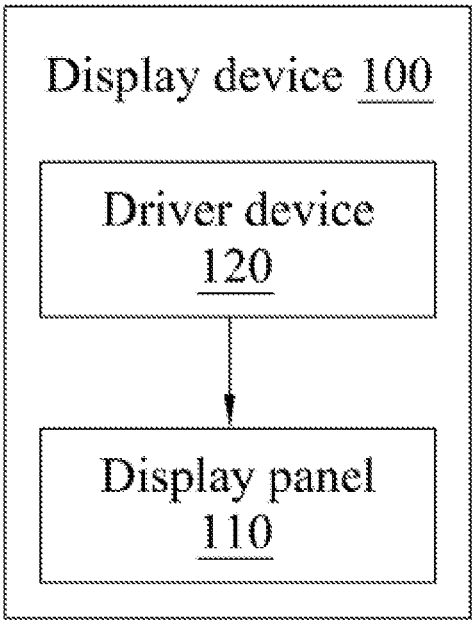
FIG. 10 is a schematic structural view of a display device of an embodiment of the present disclosure.

The present disclosure further provides a display device. As shown in FIG. 10, the display device 100 comprises a display panel 110 and a driver device 120. The driver device 120 is applied by the driver device 60 or driver device 90 of one of aforementioned embodiments. The driver device 120 applies the drive voltages to the sub-pixels of the display panel 20, to drive the display panel to display a preset image.

For example, the display device can be a liquid crystal display device, OLED display device, Q LED display device, curved display device, or flexible display device. For example, the liquid crystal display device can be TN LCD device, IPS LCD device, PLS LCD device or MVA LCD device.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A driving method of a display panel, comprising:

applying drive voltages with opposite polarities to drive positional corresponding sub-pixels of each two adjacent rows of pixel units, wherein the voltages with opposite polarities comprise voltages with positive polarity and voltages with negative polarity, the voltages with positive polarity are applied to a part of the positional corresponding sub-pixels of the two adjacent rows of pixel units, and the voltages with negative polarity are applied to the other part of the positional corresponding sub-pixels of the two adjacent rows of pixel units;

applying two drive voltages with opposite polarities to drive sub-pixels of the same pixel unit, wherein the step of applying two drive voltages with opposite polarities to drive sub-pixels of the same pixel unit, further comprises:

applying drive voltages with opposite polarities to drive each two adjacent sub-pixels of the same pixel unit, wherein the drive voltages with opposite polarities comprise the first positive polarity drive voltages and the first negative polarity drive voltages, and the first positive polarity drive voltages are applied to one of two sub-pixels, the first negative polarity drive voltages are applied to the other of two sub-pixels;

applying drive voltages with at least two voltage levels to drive the sub-pixels of the same pixel unit, and separating the plurality of sub-pixels according to the drive voltages with the voltage levels;

wherein each of the pixel units comprises a first sub-pixel, a second sub-pixel, a third sub-pixel and a fourth sub-pixel arranged sequentially, and wherein the step of applying the two drive voltages with opposite polarities to drive the sub-pixels of the same pixel unit, further comprises:

applying drive voltage with first polarity to drive the first sub-pixel and the fourth sub-pixel of the same pixel unit; and applying drive voltage with second polarity to drive the second sub-pixel and the third sub-pixel of the same pixel unit;

wherein the first polarity and the second polarity are opposite to each other.

2. The driving method according to claim 1, wherein each of the pixel units comprises four sub-pixels;

wherein the step of applying the drive voltages with at least two voltage levels to drive the sub-pixels of the same pixel unit, further comprises:

applying drive voltage with first voltage level to drive two sub-pixels of the pixel unit; and applying drive voltage with second voltage level to drive other two sub-pixels of the pixel unit.

3. The driving method according to claim 2, wherein a value of the drive voltage with first voltage level is different from a value of the drive voltage with second voltage level.

4. The driving method according to claim 1, further comprising:

within display time of two adjacent frames, applying drive voltages with opposite polarities to drive the same sub-pixel.

5. The driving method according to claim 4, wherein the display time of two adjacent frames comprises a first display time and a second display time.

6. The driving method according to claim 5, further comprising:

within the first display time, applying drive voltage with third polarity to drive the same sub-pixel; and within the second display time, applying drive voltage with fourth polarity to drive the same sub-pixel, wherein the drive voltage with third polarity and the drive voltage with fourth polarity are different in polarity.

7. A driver device of a display panel, comprising:

a first driver module configured to apply drive voltages with opposite polarities to drive positional corresponding sub-pixels of two adjacent rows of pixel units;

a second driver module configured to apply two drive voltages with opposite polarities to drive sub-pixels of the same pixel unit; and a third driver module configured to apply drive voltages with at least two voltage levels to drive sub-pixels of the same pixel unit;

wherein each of the pixel units comprises a first sub-pixel, a second sub-pixel, a third sub-pixel and a fourth sub-pixel arranged sequentially;

wherein the second driver module comprises:

a first driving unit configured to apply drive voltage with first polarity to drive the first sub-pixel and the fourth sub-pixel of the same pixel unit; and a second driving unit configured to apply drive voltage with second polarity to drive the second sub-pixel and the third sub-pixel of the same pixel unit;

wherein the first polarity and the second polarity are opposite to each other.

8. The driver device according to claim 7, wherein sizes of the first sub-pixel, the second sub-pixel, the third sub-pixel and the fourth sub-pixel are the same.

9. The driver device according to claim 7, wherein the second driver module comprises:

a third driving unit configured to apply drive voltages with opposite polarities to drive each two adjacent sub-pixels of the same pixel unit.

10. The driver device according to claim 9, wherein the drive voltages with opposite polarities comprise a drive voltage with third polarity and a drive voltage with fourth polarity, and the drive voltage with third polarity and the drive voltage with fourth polarity are different in polarity.

11. The driver device according to claim 10, wherein, within the first driving time, the third driving unit applies drive voltage with third polarity to drive the two adjacent sub-pixels of the same pixel unit, and within the second driving time, the third driving unit applies drive voltage with fourth polarity to drive the two adjacent sub-pixels of the same pixel unit.

12. The driver device according to claim 7, wherein each of the pixel units comprise four sub-pixels;

wherein the third driver module comprises:

a fourth driving unit configured to apply drive voltage with first voltage level to drive two sub-pixels of the pixel unit; and a fifth driving unit configured to apply drive voltage with second voltage level to drive other two sub-pixels of the pixel unit.

13. The driver device according to claim 12, wherein a value of the drive voltage with first voltage level is higher than a value of the drive voltage with second voltage level.

14. The driver device according to claim 12, wherein a value of the drive voltage with first voltage level is lower than a value of the drive voltage with second voltage level.

15. A driving method of a display panel, comprising:

applying drive voltages with opposite polarities to drive positional corresponding sub-pixels of the two adjacent rows of pixel units, wherein the voltages with opposite polarities comprise voltages with positive polarity and voltages with negative polarity, the voltages with positive polarity are applied to a part of the positional corresponding sub-pixels of the two adjacent rows of pixel units, and the voltages with negative polarity are applied to the other part of the positional corresponding sub-pixels of the two adjacent rows of pixel units;

wherein the step of applying the two drive voltages with opposite polarities to drive the sub-pixels of the same pixel unit, further comprises:

applying drive voltages with opposite polarities to drive each two adjacent sub-pixels of the same pixel unit, wherein the drive voltages with opposite polarities comprise first positive polarity drive voltage and first negative polarity drive voltage, the first positive polarity drive voltage is applied to one of two sub-pixel, and the first negative polarity drive voltage is applied to the other of two sub-pixel;

separating the plurality of sub-pixels of the display panel into first voltage level sub-pixels and second voltage level sub-pixels, wherein the first voltage level sub-pixels and the second voltage level sub-pixels are disposed alternately in the display panel;

applying drive voltages with first voltage level to drive the first voltage level sub-pixels; and applying drive voltages with second voltage level to drive the second voltage level sub-pixels, wherein a value of the drive voltage with first voltage level is different from a value of the drive voltage with second voltage level.

* * * * *